US011684870B1

(12) United States Patent
Maritato

(10) Patent No.: US 11,684,870 B1
(45) Date of Patent: Jun. 27, 2023

(54) FLOATING LUNGING PROP APPARATUS

(71) Applicant: Tekky, Orland Park, IL (US)

(72) Inventor: Mitch Maritato, Germantown, WI (US)

( * ) Notice: Subject to any disclaimer, the term of this patent is extended or adjusted under 35 U.S.C. 154(b) by 0 days.

(21) Appl. No.: 18/089,068

(22) Filed: Dec. 27, 2022

(51) Int. Cl.
*A63J 19/00* (2006.01)
*A63H 33/16* (2006.01)

(52) U.S. Cl.
CPC ..... *A63J 19/006* (2013.01)

(58) Field of Classification Search
CPC ..... A63H 31/00; A63H 33/00; A63H 33/16; A63H 37/00; A63H 37/005; A63G 21/18; A63J 99/00; A63J 19/006
USPC ..... 472/51, 54; 446/308
See application file for complete search history.

(56) References Cited

U.S. PATENT DOCUMENTS

| | | | | |
|---|---|---|---|---|
| 2,586,938 | A | 2/1952 | Gowland | |
| 2,927,628 | A | 3/1960 | Gill | |
| 3,664,670 | A * | 5/1972 | Glass et al. | A63H 3/36 124/16 |
| 4,507,043 | A | 3/1985 | Flatau | |
| 6,220,921 | B1 | 4/2001 | Kim | |
| 2006/0094518 | A1* | 5/2006 | Leavitt | A61H 1/006 472/51 |
| 2013/0183883 | A1* | 7/2013 | Wirt | A63H 5/00 446/397 |

FOREIGN PATENT DOCUMENTS

| | | | |
|---|---|---|---|
| GB | 2444316 | A | 6/2008 |

OTHER PUBLICATIONS

Halloween Express, Lunging Reaper Animated Prop (video), Sep. 11, 2015, retrieved from https://www.youtube.com/watch?v=wlZknx6SuBI.
Chris D, Lunging Reaper in the Buff (video), Sep. 3, 2016, retrieved from https://www.youtube.com/watch?v=GeLb3RZ-Po4.
Frightprops, Lurching Meeh, retrieved from https://www.frightprops.com/catalog/product/view/id/25322/s/lurching-mech/category/776/ on Oct. 26, 2022.
Nicolas Salenc, Making the Halloween Animatronic, Sep. 5, 2020, retrieved from https://www.youtube.com/watch?v=uesl7em6btA.
Frightprops, Simple Prop Timer, retrieved from https://www.frightprops.com/simple-prop-timer.html on Oct. 27, 2022.

* cited by examiner

*Primary Examiner* — Kien T Nguyen
(74) *Attorney, Agent, or Firm* — The Law Offices of Konrad Sherinian, LLC; Jeffrey S. Dixon

(57) ABSTRACT

A lunging prop apparatus with a stationary base, a linkage, an automation system, and prop mounts for attaching prop head and hand members. The linkage articulates in a lunging direction so that the prop head and hand members are carried in a forward linear direction from home positions to lunged positions, while at the same time being separately tipped back/up from face/palms down to face/palms forward orientations. The automation system suddenly springs the linkage forward in the lunging direction and then to produce gradual controlled movement of the linkage in a return direction back to the home position.

13 Claims, 3 Drawing Sheets

FLOATING LUNGING PROP APPARATUS

CROSS REFERENCE TO RELATED APPLICATIONS

None.

FIELD OF THE DISCLOSURE

The present invention generally relates to an amusement prop apparatus, and more particularly to freestanding amusement prop apparatus that produces sudden movement accompanied by sounds and/or lights for an amusement effect. Still more particularly, the apparatus may produce such movement and effects in response to detecting motion and/or sound, so as to surprise and amuse a person approaching or passing near the apparatus.

SUMMARY OF THE DISCLOSURE

In accordance with an aspect of the present disclosure, a lunging prop apparatus comprises a base, a linkage, an automation system and a prop mount. The base is adapted and configured to be supported on a flat surface while supporting the lunging prop apparatus. The linkage comprises a plurality of links, namely, the base and a plurality of movable links, the movable links comprising a first crank, a second crank, a third crank, a fourth crank, a first coupler link, a second coupler link, and a third coupler link. The linkage is articulable from a home position to a lunged position, in a lunging direction; and from the lunged position to the home position, in a return direction. Each of the first crank and the second crank is operative to rotate in a forward rotational direction when the linkage is articulated in the lunging direction, so as to move the first coupler link in a forward linear direction. Each of the first crank and the third crank is pivotally connected to each of the first coupler link and the second coupler link. Each of the third crank and the fourth crank is pivotally connected to each of the first coupler link and the third coupler link. The fourth crank is operative to rotate in a rearward rotational direction opposite the forward rotational direction when the linkage is articulated in the lunging direction. The prop mount is affixed to the fourth crank. In embodiments, another prop mount is affixed to the third crank. The automation system is operatively connected to the linkage so as to be operable to drive the linkage to articulate suddenly from the home position to the lunged position in the lunging direction and to drive the linkage more gradually from the lunged position to the home position in the return direction.

BRIEF DESCRIPTION OF THE DRAWINGS

Although the characteristic features of this disclosure will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

Figure 1:
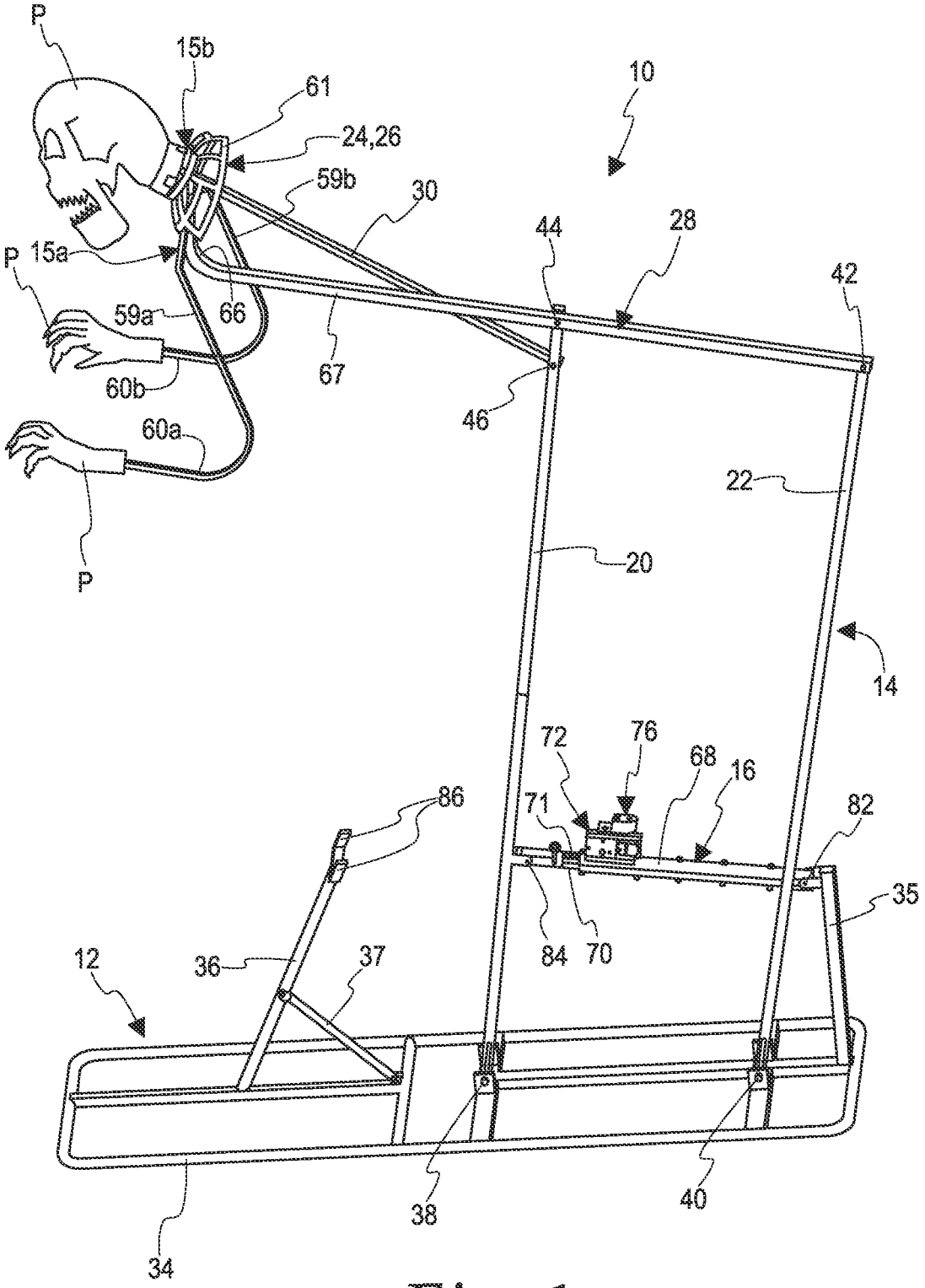
FIG. 1 is a top left perspective view of a lunging prop apparatus according to the disclosure, in a home position.

A person of ordinary skill in the art will appreciate that elements of the figures above are illustrated for simplicity and clarity and are not necessarily drawn to scale. The dimensions of some elements in the figures may have been exaggerated relative to other elements to help understanding of the present teachings. Furthermore, a particular order in which certain elements, parts, components, modules, steps, actions, events and/or processes are described or illustrated may not be actually required. A person of ordinary skills in the art will appreciate that, for the purpose of simplicity and clarity of illustration, some commonly known and well-understood elements that are useful and/or necessary in a commercially feasible embodiment may not be depicted in order to provide a clear view of various embodiments in accordance with the present teachings.

DETAILED DESCRIPTION

In the following description of various examples of embodiments of the disclosed systems and methods, reference is made to the accompanying drawings, which form a part hereof, and in which are shown by way of illustration various example devices, systems, and environments in which aspects of the disclosed systems and methods can be practiced. Other specific arrangements of parts, example devices, systems, and environments, can be used, and structural modifications and functional modifications can be made without departing from the scope of the disclosed systems and methods.

Described here and illustrated in the accompanying drawings are lunging prop apparatuses according to the present disclosure. An embodiment of a lunging prop apparatus is more particularly described and illustrated in the accompanying drawings as a lunging prop apparatus 10. The lunging prop apparatus 10 comprises a base 12; an articulable linkage 14 that includes the base 12 and a plurality of movable links connected to the base 12; prop mounts 15*a*, 15*b* connected to the linkage 14; an automation system connected to the linkage (embodied as an integral automation module, illustrated and described here as the extension module 16); and an electrical system 18 that is operative to supply power to the extension module 16, as well as to power sounds and lights coordinated with movements of the prop mounts 15*a*, 15*b* as the linkage 14 is articulated. The linkage 14 is articulable from a home position to a lunged position in a lunging direction and from the lunged position to the home position in a return direction. The extension module 16 is operative to produce such articulation of the linkage 14 from the home position to the lunged position suddenly, and to produce more gradually such articulation of the linkage 14 from the lunged position to the home position.

The base 12 is adapted and configured to be supported on a support, the lunging prop apparatus 10 being adapted and configured to be supported by the base 12. Specifically, the base 12 is a frame structure that is adapted and configured to rest or be secured and held stationary during normal operation of the lunging prop apparatus 10, on a generally horizontal support surface (not shown), such as that of an indoor or outdoor floor, deck, patio, tabletop or countertop, grass lawn, driveway, street, sidewalk, or the like. More particularly, the base 12 is adapted and configured so that the apparatus 10 is freestanding such a horizontal support surface, when the linkage 14 is at rest and in a home position described below. Suitable fasteners or weights (e.g., sandbags, not shown) can be used to secure the base 12 on such a support surface, so as to prevent the base 12 from tipping over when the linkage 14 is in motion or in a lunged position described below. Other suitable supports on which an apparatus according to the present disclosure may be supported may include non-horizontal supports, such as a wall, column, or upright member(s) of a frame structure, to which a base, such as the base 12 and/or a differently adapted and configured base of another embodiment, may be secured. Other suitable bases may be adapted and configured to be movably supported on a support. For example, in other embodiments of a lunging prop apparatus according to the present disclosure, a base may be movably supported on a generally horizontal support surface by wheels, casters, bi- or omnidirectional rollers, runners, or glides.

The linkage 14 comprises a plurality of interconnected links, namely, the stationary base 12 and movable links including a first crank 20, a second crank 22, a third crank 24, a fourth crank 26, a first coupler link 28, a second coupler link 30, and a third coupler link 32. The base 12 has a base frame 34, which is adapted and configured to rest on a horizontally oriented support. In addition, the base 12 includes an automation module mounting column 35 and a stop bar 36, each of which comprises an elongate member affixed to and extending generally upwardly from the base frame 34 in a vertical plane of articulation (described below) of the linkage 14. More particularly, the mounting column 35 extends substantially vertically, and the stop bar 36 is disposed in front of and inclined rearwardly towards the first crank 20. In addition, the stop bar 36 is reinforced by a forwardly inclined tensile corner brace member 37 that is connected between a rear side of the stop bar 36 and the base frame 34. The mounting column 35 can likewise be reinforced by a similar tensile corner brace member (as illustrated in the schematic views of FIGS. 3-5) connected to extend between the mounting column and a point on the base frame 34 in front of the mounting column 35, to reinforce the mounting column 35 for rearward bending loading produced by the extension module 16 driving lunging articulation of the linkage 14.

By "interconnected links," it is meant that each link is connected to every other link, either directly or indirectly. Each link may be indirectly connected to one or more of the other links by way of one or more intervening links and/or by way of one or more series of intervening links. For example, as illustrated in the drawings, the base 12 is connected to the first crank 20 both directly and indirectly. Further, the links of the linkage 14 are interconnected by joints that permit the linkage to articulate in a vertical plane. More particularly, the linkage 14 articulates with a single degree of freedom; that is, the relative position and movement of any movable link relative to the base 12 determines the relative positions and movements of all the other movable links. Accordingly, each movable link has home and lunged positions corresponding to the home and lunged positions of the linkage 14 and is operative to move to and from the home and lunged positions in lunging and return directions of link movement corresponding to the respective lunging and return directions of linkage articulation.

Still more particularly, the joints are pivotal joints with parallel, horizontal axes of rotation. Still more particularly, the links of the linkage 14 are interconnected as follows: The base 12 is directly connected to the first crank 20 by a first pivotal joint 38 on the base frame 34. In addition, the base 12 is indirectly connected to the first crank 20 via the second crank 22 and the first coupler link 28, the second crank 22 being directly connected to the base 12 at a second pivotal joint 40 on the base frame 34, the first coupler link 28 being directly connected to the second crank 22 at a third pivotal joint 42, and the first crank 20 being directly connected to the first coupler link 28 at a fourth pivotal joint 44. (The base 12 is also indirectly connected to the first crank 20 by the extension module 16 described in more detail below, which itself comprises a pair of links connected by a sliding joint having a straight line of articulation that remains parallel to the vertical plane of articulation of the linkage 14 as the extension module 16 pivots relative to the base 12 and first crank 20.) The first crank 20 is also pivotally connected to the second coupler link 30 at a fifth pivotal joint 46. The third crank 24 is pivotally connected to the first coupler link 28 at a sixth pivotal joint 48, to the second coupler link 30 at a seventh pivotal joint 50, and to the third coupler link 32 at an eighth pivotal joint 52. The fourth crank 26 is pivotally connected to the first coupler link 30 at a ninth pivotal joint 54 and to the third coupler link 32 at a tenth pivotal joint 56.

One skilled in the art will understand that the linkage 14 thus comprises three different four-bar pivotal sub-linkages, identified by the reference numerals of their respective four links as a first sub-linkage 28, 22, 12, 20; a second sub-linkage 28, 24, 30, 20, the second sub-linkage sharing a directly connected pair of links 20, 28 with the first sub-linkage; and a third sub-linkage 28, 24, 32, 26, the third sub-linkage sharing a directly connected pair of links 28, 24 with the second sub-linkage. It is further understood that the relative positions of any two links of a four-bar pivotal linkage determines the positions of the other two. Accordingly, the three four-bar sub-linkages are mutually interdependent, in that: (1) Any articulation of the first sub-linkage 28, 22, 12, 20 drives articulation of the second sub-linkage 28, 24, 30, 20, which in turn drives articulation of the third sub-linkage 28, 24, 32, 36; (2) Any articulation of the second sub-linkage directly drives articulation of the first and third sub-linkages; and (3) Any articulation of the third sub-linkage drives articulation of the second, which in turn drives articulation of the first. Therefore, it will be appreciated that the linkage 14 has one degree of freedom of articulation in opposed lunging and return directions.

In the illustrated embodiment, the prop mount 15*a* comprises a horizontal shoulder bar 57, which is affixed to the third crank 24 and extends generally along the axis of the sixth pivotal joint 48, and a pair of laterally spaced apart, arm members connected at opposite ends of the horizontal bar 57. The arm members are generally disposed in vertical planes that are parallel to the plane of articulation of the linkage 14 and spaced apart to opposite lateral sides of the third crank 24, each arm member having a straight upper arm segment 59*a*, 59*b* joined at a right angle to the shoulder bar 57 and a straight forearm segment 60*a*, 60*b* joined to the upper arm segment 59*a*, 59*b* by a curved elbow segment so as to extend at an acute angle to the upper arm segment 59*a*, 59*b*. The prop mount 15*b*, on the other hand, comprises a base plate with upturned tabs that are operative to receive an inserted base of a prop member, such as a neck portion of the head member of the prop P, which may be affixed to the tabs by any suitable manner, for example by adhesive, fasteners, or friction.

The first and second cranks 20 and 22 are illustrated as being connected at opposite lateral sides (depicted as right and left sides, respectively, though the reverse is also possible) of the first coupler link 30, which is believed to promote greater stability of the linkage 14, although embodiments with multiple cranks connected to the same lateral side of a coupler link are possible. Similarly, the first coupler link 30 and the second coupler link 32 are connected at opposite lateral sides of the first crank 20, thus permitting the coupler links 30 and 32 to cross each other in a vertical plane without impingement, while allowing both links to have a generally flat, elongate shape in their respective vertical planes (free of any lateral bends), as illustrated in the perspective views of FIGS. 1 and 2.

The pair of prop mounts 15*a*, 15*b*, adapted and configured for fixedly mounting the respective hands and head of a frightening prop figure (designated P in FIGS. 1-5) are fixedly connected to the third crank 24 and the fourth crank 26, respectively. In other embodiments, a prop may be a spider, ghost, clown, or any of various other animal and character forms of a lunging figure with separately articulating body parts.

In some embodiments, a prop is included with a draped piece of fabric (not shown), which may represent a cloak or other garment of the prop figure, while also surrounding the apparatus on all sides. Such a draped piece of fabric can serve to hide its mechanical and electrical components, so as to enhance the surprise effect when the linkage springs to the lunged position, causing sudden movement of the prop. The illustrated embodiment of the lunging prop apparatus 10 further includes a shoulder cage 61 that is operative to support and impart a desired upper body shape to such a hanging garment. The shoulder cage 61 is illustrated as being affixed to the fourth crank 26 so as to rotate together with a prop member affixed thereto, such as the head of the prop P. In other embodiments, the shoulder cage can be affixed to another link, for example the third crank 24 so as to rotate together with the hands of the prop P, or to the first coupler link 28, so as to remain substantially upright as the head and hand members of the prop P rotate with the articulation of the linkage 14.

Figure 2:
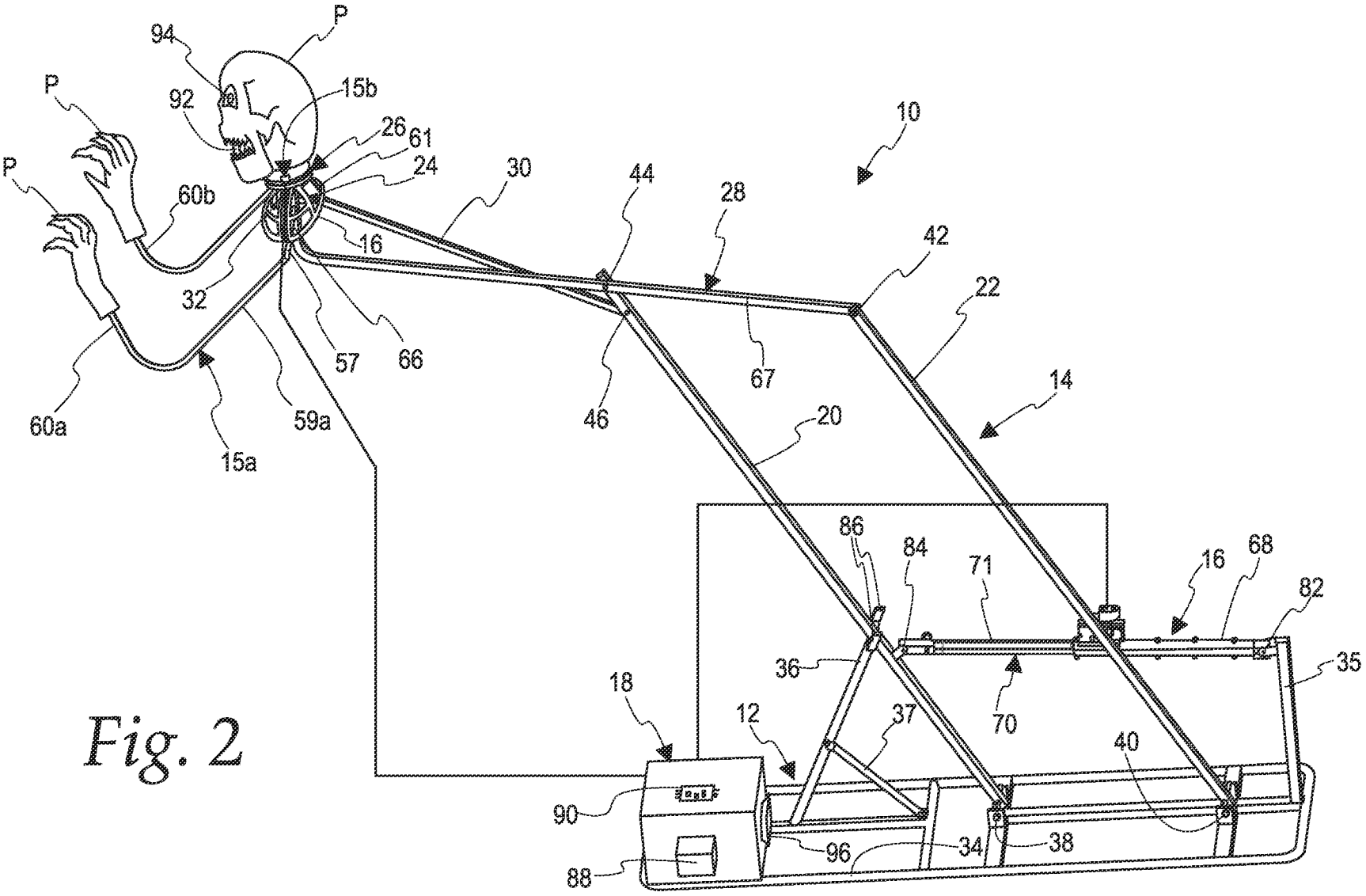
FIG. 2 is a top left perspective view of the apparatus of FIG. 1 in a lunged position, further illustrating an electrical system for the apparatus.
Figure 3:
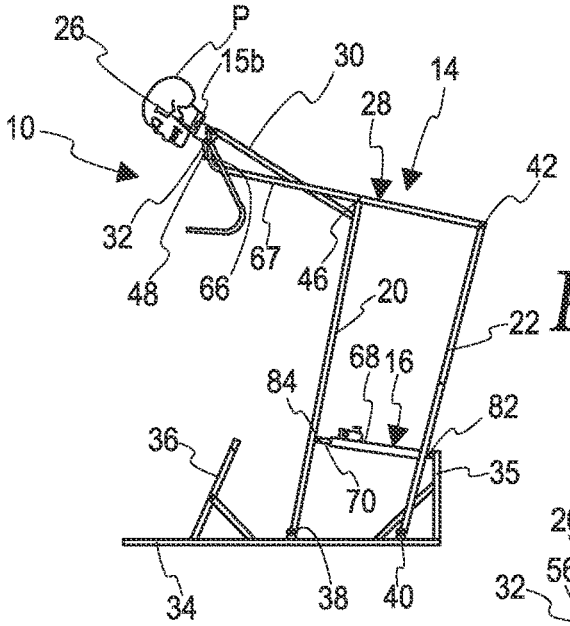
FIG. 3 is a left side elevation schematic view of a linkage of the apparatus of FIG. 1 in a home position.
Figure 4:
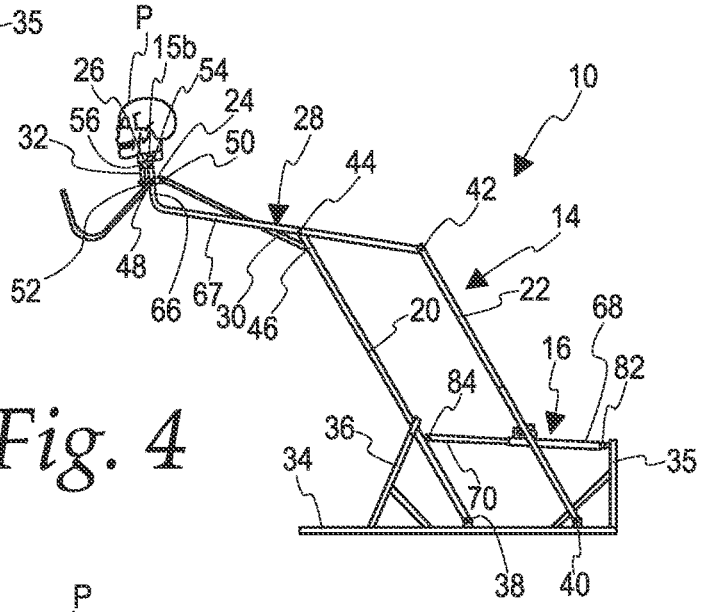
FIG. 4 is a left side elevation schematic view of the linkage of the apparatus of FIG. 1 in a lunged position.
Figure 5:
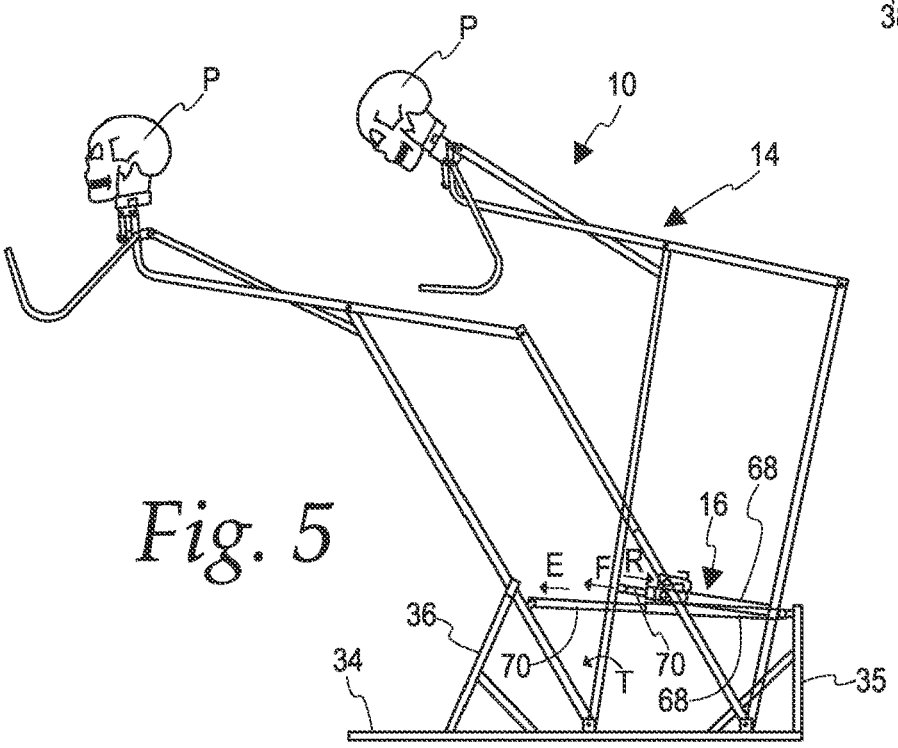
FIG. 5 is a left side elevation illustration of the articulation of the linkage of the apparatus of FIG. 1 from the home position to a lunged position.

The linkage 14 is articulable in a lunging direction from a home position to a lunged position and in a return direction from the lunged position to the home position. The home position of the linkage 14 is illustrated in FIGS. 1, 3 and 5, and the lunged position of the linkage 14 is illustrated in FIGS. 2, 4 and 5. In the illustrated embodiment, the home position is a position of the linkage 14 in which the prop mounts 15*a*, 15*b* are at their most rearward positions relative to the base 12 over the range of articulation of the linkage 14, and the lunged position is a position of the linkage 14 in which the prop mounts 15*a*, 15*b* are at their most forward positions relative to the base 12. In other embodiments not shown, particularly those in which a base is supported on a wall or other vertically oriented support with the prop mount end of a linkage facing upward or downward, a home position of a linkage may be a position in which the prop mounts are at their lowest or highest positions for the range of linkage articulation, and a lunged position of the linkage that in which the prop mounts are at their corresponding highest or lowest positions.

The prop mounts 15*a* and 15*b*, being respectively affixed to the third and fourth cranks 24, 26, are each directly connected to the first coupler link 28 so as generally to follow its translational movement. That is, generally to be translated forwardly, as the first coupler link 28 is carried by the first and second cranks 20, 22, which, throughout the range of articulation of the linkage 14, are near the tops of their respective pivotal arcs. At the same time, the third and fourth cranks 24, 26 are connected to the linkage 14 in such a manner that they rotate in lunging and return directions opposite to those of the first and second cranks 20, 22 when the linkage 14 is articulated. Thus, the third and fourth cranks 24, 26 rotate "rearwardly," that is, clockwise when viewed from the left side of the plane of linkage articulation, as they are carried forwardly during lunging articulation. More particularly, in the home position of the linkage 14, as best seen in FIG. 1, the upper arm segments 59*a*, 59*b* of the prop mount 15*b* extend generally downwardly and slightly rearwardly from the shoulder bar 57, and the forearm segments 60*a*, 60*b* extend generally forwardly from the elbow segments at a slightly upward angle to the frame 34, so that the hand members are generally directly below the head member of the prop P, palms down, while the prop mount 15*b* faces forward, so that the attached head member faces down at the hand members. In the lunged position, the arm members are tipped back so that the upper arm segments 59*a*, 59*b* extend forwardly and downwardly from the shoulder bar 57, and the forearm segments 60*a*, 60*b* extend forwardly and upwardly from the elbow segments, so that the attached hand members are outstretched in front of the head member, palms forward, and the prop mount 15*b* faces upward, so that the attached head faces forward.

In addition, the third and fourth cranks 24, 26 are connected to a generally vertical forward segment 66 of the first coupler link 28 (the first coupler link 28 being generally L-shaped and also comprising a generally horizontal rear segment 67), with the fourth crank 26 connected above the third crank 24, so that the head of the prop P tilts forwardly and rearwardly about a higher axis than that of the arm members 59*a-b*, 60*a-b*, the hands of the prop P being attached at distal ends of the forearm segments 60*a*, 60*b*. This results in backward tilting movements of the head and hands of a threatening prop figure about separate axes, from a crouched, downward-facing pose to a startling, forward-facing pose as the figure lunges forward. In other embodiments, a linkage may comprise a third crank that is connected to first and second coupler links for rotation opposite to that of a first crank and a second crank, and a prop mount connected to the third crank, but not a fourth crank analogous to that of the linkage 14 or the associated prop mount. In such embodiments, the prop member or members attached to the prop mount may comprise only hand members that tip back from a downward to a threatening pose during a lunge, only a head member that tips from face down to face forward, or a single prop body incorporating both head and hand members in relatively fixed positions.

Automation systems for driving a lunging prop apparatus linkage according to the disclosure will now be described, with particular reference to the illustrated embodiment of an extension module 16 as an example of an integrated automation module that comprises such an automation system. A suitable automation system includes a springing mechanism operative to produce sudden articulation of a linkage in a lunging direction for a surprise effect, a motive device operative to produce more gradual articulation of the linkage in a return direction, and a transmission operative to transmit movement from the motive device to the linkage. In embodiments, the springing mechanism and the motive device are separate mechanisms, the transmission is engageable and disengageable, such as by a suitable clutch mechanism, and, when engaged, the transmission is operative to restrain or substantially or wholly prevent articulation not driven by the motive device, including articulation driven by the springing mechanism.

In more particular embodiments, including the illustrated embodiment, the springing mechanism comprises a biasing element that passively stores potential energy, such as a solid mechanical tension, compression, or torsion spring; weights hung from an input crank at a distance from its pivot point relative to a stationary base, to produce a desired biasing torque; or a volume of compressed gas, such as that of a gas spring or a pneumatic actuator. In such embodiments, the motive device is operative to gradually add potential energy to the biasing element by moving a link so as to articulate the linkage in the return direction, and a transmission disengagement mechanism (e.g., a clutch) is operative to release the stored potential energy suddenly by disengaging the transmission so as to decouple the position and movement of the motive device from the position and articulation of the linkage.

In other embodiments of an unfolding springing amusement apparatus, a pneumatic component produces folding and lunging articulation of a linkage at desired speeds, omitting an electromagnetic drive motor, a separate spring, and/or a clutch. In one embodiment, a suitable single acting pneumatic air cylinder component (not shown) drives a desired sudden articulation of a linkage when pressurized, while a return force from gravity or a return spring (which may be a separate spring component or part of the air cylinder component itself) reverses the articulation when air pressure is either entirely removed from the air cylinder component or sufficiently reduced to produce a an air cylinder force at a desired level less than that of the return force. In another embodiment, a pneumatic rotary actuator (not shown) drives the desired folding and unfolding linkage articulations, for example, by directly engaging a pivotal joint of the linkage. In another embodiment, a suitable dual acting pneumatic cylinder (not shown), activated by a compressor and a manual or solenoid valve or air switch, drives the desired lunging and return linkage articulations. Optionally, air output from the compressor may be limited by the compressor itself or by a separate pressure regulator. The dual acting pneumatic cylinder may have its speed of extension and retraction controlled by a flow control valve, to control the speed of linkage articulations. The dual acting pneumatic cylinder obviates the need for a brake or clutch, as the cylinder can drive bidirectional movements and can be pressurized rapidly enough to produce sudden "lunging" articulation even if it engages the linkage before it is fully pressurized.

In the illustrated embodiment in particular, a biasing element, motive device, transmission, and clutch of an automation system are embodied in a single integrated automation module, namely, the extension module 16. More particularly, the extension module 16 includes an elongate extension cylinder 68, an extension rod 70 movably mounted within the extension cylinder 68, the biasing element (not shown) being housed in the extension cylinder 68, the motive device and transmission being embodied in a drive module 72 mounted to the extension cylinder 68, and the clutch being embodied in a clutch module 76 mounted to the extension cylinder 68. The biasing element is connected between the extension rod 70 and cylinder 68 so as to bias the extension rod 70 to extend linearly from the cylinder 68. The drive module 72 is operative to transmit controlled movement of the motive device through the transmission to move the extension rod 70 relative to the extension cylinder 68, as well as to hold the extension rod 70 in place against a biasing force from the biasing element when the motive device is not in motion and the transmission is engaged. The clutch module 76 is operative to engage and disengage the transmission.

More particularly, the drive module 72 comprises an electric motor (hidden) as a motive device and a gear train (hidden) as a transmission, and the clutch module 76 is operative to engage and disengage the transmission by causing a clutch gear to mesh to and un-mesh from the gear train. The clutch module 76 comprises a motor operative to drive an eccentric clutch cam (not shown), which in turn is operative to cause the clutch gear to move axially into and out of plane with another gear of the gear train so as to mesh with and un-mesh from that gear. (A more detailed explanation of suitable drive and clutch modules of an analogous extension module is given in U.S. Pat. No. 11,148,067, the entire disclosure of which is hereby incorporated herein by reference.)

The extension cylinder 68 is pivotally connected to the automation module mounting column 35 at a pivotal cylinder mount 82. The extension rod 70 is slidably retained in the extension cylinder 68 so as to be movable in opposed longitudinal extension and retraction directions E and R (as indicated in FIG. 5) relative to the extension cylinder 68, and pivotally connected to the first crank 20 at a pivotal rod mount 84. The extension rod 70 has a linear tooth rack 71 (FIGS. 1, 2) that meshes with an output gear (hidden) of the drive module 72, so as to be driven by rotation of the output gear when the motive device is in motion and the transmission is engaged.

With reference to FIG. 5, when the extension module 16 is so connected to the linkage 14 with the drive transmission disengaged, the biasing element biases the extension rod 70 to push against the first crank 20 in the extension direction E, so as to supply a lunging biasing force F and a lunging biasing torque T in a generally counterclockwise direction (as viewed from the left side of the linkage), biasing the first crank 20 to rotate counterclockwise (its lunging direction) and thus biasing the linkage 14 to articulate in the lunging direction.

Conversely, when the drive transmission is engaged and the motive device is in motion in a retraction/return direction, the drive module 72 is operative to rotate the output gear so as to drive the extension rod 70 to retract into the extension cylinder 68 in the retraction direction R, in opposition to the biasing force F. This retraction of the extension rod 70 pulls the first crank 20 generally rearwardly, causing the link 20 to rotate clockwise (its return direction, as viewed from the left side of the linkage 14) so as to articulate the linkage 14 in the return direction until the linkage 14 reaches the home position with extension rod 70 fully retracted. In addition, as long as the transmission remains engaged, the drive module 72 is operative to restrain the output gear from rotating when the motive device is not in motion, so that the output gear bears against the linear tooth rack 71 so as to oppose the biasing force F and hold the extension rod 70 in its retracted position, thereby holding the linkage 14 in its home position.

According to a system and method of use, the clutch module 76 is operative and operated to disengage the transmission when the linkage 14 is in the home position, that is, when the extension rod 70 is fully retracted, to allow the biasing element of the extension module 16 to drive sudden lunging articulation of the linkage 14, decoupled from the drive module 72. Conversely, the clutch module 76 is operative and operated to engage the transmission when the linkage 14 is in the lunged position, with the extension rod 70 extended, to allow the drive module 72 to drive return articulation of the linkage 14 so as to restore potential energy to the biasing element. However, the clutch module 76 can be capable of engaging and disengaging the transmission at other positions of the extension rod 70 corresponding to other positions of the linkage 14 and can be so operative and so operated according to other methods of use.

In other embodiments of a linkage automated by an extension module, the extension module can be pivotally connected between any pivotally connected pair of links of a lunging prop apparatus linkage, so that movement of the extension rod in a first longitudinal direction relative to the extension cylinder causes lunging articulation of the linkage, and so that movement of the extension rod in a second longitudinal direction relative to the extension cylinder, opposite the first, causes return articulation of the linkage. Thus, an extension module can be connected to a lunging prop apparatus linkage so that the directions of linkage articulation produced by its extension and retraction are reversed compared the illustrated embodiment, such as by being mounted in front of the input crank instead of behind it. Likewise, an extension module that is biased by a biasing element to retract, and driven by a motor to extend, instead of the reverse as in the illustrated embodiment, can be connected to a linkage in either foregoing configuration.

As mentioned above, the linkage 14 is in its home position when the extension rod 70 is fully retracted into the extension cylinder 68. Put another way, the fully retracted position of the extension rod 70 determines the home position of the linkage 14. Conversely, the extension module 16 is typically adapted and configured so that the extension rod 70 at a fully extended position "tops out" against a suitable obstruction of the extension cylinder 68 to prevent its further extension. In embodiments, such topping out of the extension rod 70 can provide the sole mechanical stop limit on the lunging articulation of a lunging prop apparatus linkage.

In the illustrated embodiment on the other hand, the base 12 includes the previously mentioned stop bar 36. A distal (upper, as illustrated) end of the stop bar 36 is operative to abut a leading side or edge of the first crank 20 when the linkage 14 reaches the lunged position, so as to block further movement of the first crank 20 in its lunging direction, and thus to block further lunging articulation of the linkage 14. In addition, the stop bar 36 includes lateral guard stops 86 that extend from the stop bar 36 in opposite lateral directions, and in the return direction in lateral planes parallel to the plane of articulation of the first crank 20, so as overlap lateral sides of the first crank 20 in those lateral planes. The lateral guard stops 86 are operative to block the first crank 20 from bypassing the stop bar on one or the other of its lateral sides, in case the first crank 20 is deflected out of its plane of articulating movement, such as by the momentum of the linkage 14 being redirected laterally. Beneficially, the stop bar 36 can isolate the extension module 16 from all or a substantial portion of loads associated with stopping momentum of the linkage 14 in the lunging direction.

As mentioned above, the lunging prop apparatus 10 further comprises the electrical system 18. The electrical system 18 includes a suitable power supply 88 (such as a battery, illustrated schematically in FIG. 2), a control board 90, a sensor 92, a light 94 (which may comprise, for example, a light emitting diode), and a sounder 96. The control board 90, sensor 92, light 94, and sounder 96 are operatively connected to the power supply 88, the sensor 92 being adapted and configured to detect an input signal and to transmit a sensor trigger signal to the control board 90 in response to detecting the input signal. The control board 90 is in turn adapted and configured to respond to the trigger signal by causing the clutch module 76 to disengage the transmission of the drive module 72 in response to receiving the sensor trigger signal from the sensor 92. For example, the control board 90 may cause a clutch motor of the clutch module 76 to be energized with current from the power supply 88 so as to rotate a clutch cam to a transmission disengagement position that disengages a clutch gear from a drive geartrain of the drive module 72.

Optionally, the electrical system 18 may include any suitable wired manual trigger (not shown), either in lieu of or in addition to the sensor 92, operable by a user to manually initiate transmission of the sensor trigger signal to the control board 90. A wired manual trigger may, for example, be a footpad (not shown) wrapped in a soft vinyl housing, which transmits vibrations generated by a user stepping on the footpad as a sound signal to a sound sensor associated with the control board 90, where the sound sensor thus signaled by the footpad may comprise the sensor 92 or an additional or alternative sensor not shown. Another type of wired footpad trigger may comprise electrical contact sheets spaced apart vertically by a compressible layer, e.g. foam, similarly wrapped in a soft vinyl housing, the compressible layer having holes through which the sheets come into contact. Other suitable manual triggers may include a hand-operated switch, such as a contact switch or a button.

At some point after the linkage 14 reaches the lunged position, the control board 90 is further adapted and configured to activate the clutch module 76 to engage the drive transmission, to energize the motive device of the drive module 72 with current from the power supply 88 so as to transmit movement from the motive device to the extension rod 70, so as to cause the linkage 14 to articulate in the return direction from the lunged position to the home position, and to cease the supply of energizing current from the power supply 88 to the drive module 72 when the linkage 14 reaches the home position. In addition, in response to the trigger signal the control board 90 is further adapted and configured to energize the light 94 and the sounder 96 with current from the power supply 88, to cause the light 94 and the sounder 96 to produce light and sound effects, such that the light and sound effects coordinate as desired with the movement and positions of the prop members P, as determined by the articulation of the linkage 14. Preferably, the light and sound effects are visible and audible to a person of normal, unaided vision and hearing, at a distance of 10 feet, and more preferably at a distance of 100 feet, from the lunging prop apparatus 10.

The sensor 90 may be adapted and configured to detect any of a variety of suitable input signals as appropriate for a desired application of the lunging prop apparatus 10. For example, the sensor 90 may be a "human sensor" that is operative to detect a passive infrared radiation (PIR) signal emitted from a person near the sensor 90, so as to surprise the person by triggering the lunging prop apparatus 10 as the person approaches. In other embodiments, the sensor 90 may be operative to detect an audible sound signal, a visible light signal, a powered infrared signal emitted by a remote control, or a radio frequency signal. For example, the sensor 90 may be adapted and configured to detect a Bluetooth® Low Energy or Bluetooth® Classic signal (or equivalent UHF radio signal) emitted by a user's personal electronic device. Thus, for example, a human user may trigger the lunging prop apparatus 10 from the user's smartphone or tablet.

The foregoing description of the disclosure has been presented for purposes of illustration and description and is not intended to be exhaustive or to limit the disclosure to the precise form disclosed. The description was selected to best explain the principles of the present teachings and practical application of these principles to enable others skilled in the art to best utilize the disclosure in various embodiments and various modifications as are suited to the particular use contemplated. It should be recognized that the words "a" or "an" are intended to include both the singular and the plural. Conversely, any reference to plural elements shall, where appropriate, include the singular.

It is intended that the scope of the disclosure not be limited by the specification, but be defined by the claims set forth below. In addition, although narrow claims may be presented below, it should be recognized that the scope of this invention is much broader than presented by the claim(s). It is intended that broader claims will be submitted in one or more applications that claim the benefit of priority from this application. Insofar as the description above and the accompanying drawings disclose additional subject matter that is not within the scope of the claim or claims below, the additional inventions are not dedicated to the public and the right to file one or more applications to claim such additional inventions is reserved.

What is claimed is:

1. A lunging prop apparatus, comprising:

a base;

a linkage;

an automation system;

a prop mount;

the base being adapted and configured to be supported on a flat surface, the lunging prop apparatus being adapted and configured to be supported by the base on the flat surface;

the linkage comprising a plurality of links, the links comprising the base and a plurality of movable links, the movable links comprising a first crank, a second crank, a third crank, a fourth crank, a first coupler link, a second coupler link, and a third coupler link;

the linkage being articulable from a home position to a lunged position, in a lunging direction;

the linkage being articulable from the lunged position to the home position, in a return direction;

each of the first crank and the second crank being operative to rotate in a forward rotational direction when the linkage is articulated in the lunging direction so as to move the first coupler link in a forward linear direction;

each of the first crank and the third crank being pivotally connected to each of the first coupler link and the second coupler link;

each of the third crank and the fourth crank being pivotally connected to each of the first coupler link and the third coupler link;

the fourth crank being operative to rotate in a rearward rotational direction opposite the forward rotational direction when the linkage is articulated in the lunging direction;

the prop mount being affixed to the fourth crank;

the automation system being operatively connected to the linkage so as to be operable to drive the linkage to articulate suddenly from the home position to the lunged position in the lunging direction and to drive the linkage more gradually from the lunged position to the home position in the return direction.

2. The lunging prop apparatus of claim 1 wherein the automation system comprises an automation module including a biasing element, a motive device, and a transmission, further comprising:

the biasing element being operatively connected between a biased pair of the links so as to bias the linkage to articulate in the lunging direction;

the motive device and the transmission being operatively connected between a driven pair of the links, the transmission being engageable when the linkage is in the lunged position and disengageable when the linkage is in the home position;

the transmission being operative, when engaged, to transmit a movement of the motive device to the driven pair of links, so as to move one of the driven pair of links relative to the other, so as to produce articulation of the linkage in the return direction, and when disengaged, to free the linkage to be articulated in the lunging direction independently of the movement of the motive device.

3. The lunging prop apparatus of claim 2, further comprising a control board, a sensor, and a power supply, the control board and sensor being operatively connected to the power supply, the sensor being adapted and configured to detect an input signal and to transmit a sensor trigger signal to the control board in response to detecting the input signal, the control board being adapted and configured to cause the transmission to be disengaged in response to receiving the sensor trigger signal from the sensor, and when the linkage is in the lunged position, to cause the transmission to be engaged, the motive device to be moved, and the transmission to transmit the movement of the motive device to the linkage to cause the linkage to articulate in the return direction from the lunged position to the home position.

4. The lunging prop apparatus of claim 3 wherein the sensor is adapted and configured to detect as the input signal a signal selected from the group consisting of a passive infrared radiation signal emitted from a human near the sensor, a sound signal, a visible light signal, a powered infrared signal emitted by a remote control, and a radio frequency signal.

5. The lunging prop apparatus of claim 3, further comprising a sounder, the control board being adapted and configured to cause the sounder to produce a sound when the input signal is detected by the sensor.

6. The lunging prop apparatus of claim 3, further comprising a light source, the control board being adapted and configured to cause the light source to emit visible light when the input signal is detected by the sensor.

7. The lunging prop apparatus of claim 2, further comprising the transmission including an extension cylinder, an extension rod, and an output gear;

the extension cylinder being pivotally mounted to the base;

the extension rod having a length and a linear tooth rack comprising longitudinally distributed driven teeth, the extension rod being slidably connected to the extension cylinder to permit movement of the extension rod in opposed first and second longitudinal directions relative to the extension cylinder, the extension rod having a proximal end disposed in the extension cylinder and a distal end pivotally connected to an input crank, the input crank being one of the first crank and the second crank, such that movement of the extension rod in the first longitudinal direction causes rotation of the input crank in a lunging direction relative to the base, which in turn causes the linkage to articulate in the lunging direction, and such that movement of the extension rod in the second longitudinal direction produces rotation of the input crank in a return direction relative to the base, which in turn causes the linkage to articulate in the return direction;

the output gear being operatively connected to the motive device to be rotated in a drive direction by the motive device when the motive device is moved, the output gear having drive teeth meshed with the driven teeth of the extension rod such that rotation of the output gear in a drive direction causes the extension rod to move in the second longitudinal direction.

8. The lunging prop apparatus of claim 7 wherein the first longitudinal direction is a direction in which the extension rod is adapted and configured to retract into the extension cylinder, and the second longitudinal direction is a direction in which the extension rod is adapted and configured to extend out of the extension cylinder.

9. The lunging prop apparatus of claim 1 wherein the prop mount is a first prop mount, further comprising a second prop mount, the second prop mount being affixed to the third crank, the third crank being operative to rotate in the rearward rotational direction when the linkage is articulated in the lunging direction.

10. The lunging prop apparatus of claim 9, further comprising a prop head attached to the first prop mount and prop hands attached to the second prop mount.

11. The lunging prop apparatus of claim 10 wherein the first coupler link is an L-shaped member having a generally horizontal segment and a generally vertical segment, the first crank being connected to the generally horizontal segment, the second crank being connected to the generally horizontal segment behind the first crank, the third crank being connected to the generally vertical segment, and the fourth crank being connected to the generally vertical segment above the third crank.

12. The lunging prop apparatus of claim 1 wherein the linkage is adapted and configured to articulate only in a single plane of articulation.

13. The lunging prop apparatus of claim 12 wherein the linkage plane of articulation is a vertical plane when the support is a horizontal surface, the base resting on the horizontal surface.

* * * * *